US008890035B2

(12) United States Patent
Scheunert et al.

(10) Patent No.: US 8,890,035 B2
(45) Date of Patent: Nov. 18, 2014

(54) HAIRDRYER APPLIANCE

(75) Inventors: Peter Scheunert, Kuenzell (DE); Andreas Gobel, Eiterfeld (DE)

(73) Assignee: Exonda Salon Tools GmbH, Eiterfeld (DE)

( * ) Notice: Subject to any disclaimer, the term of this patent is extended or adjusted under 35 U.S.C. 154(b) by 126 days.

(21) Appl. No.: 13/322,427

(22) PCT Filed: May 27, 2010

(86) PCT No.: PCT/EP2010/003228

§ 371 (c)(1),
(2), (4) Date: Feb. 13, 2012

(87) PCT Pub. No.: WO2010/136205

PCT Pub. Date: Dec. 2, 2010

(65) Prior Publication Data

US 2012/0125909 A1 May 24, 2012

(30) Foreign Application Priority Data

May 27, 2009 (EP) ..... 09007111

(51) Int. Cl.
*A45D 20/10* (2006.01)
*A45D 20/12* (2006.01)

(52) U.S. Cl.
CPC ..... *A45D 20/12* (2013.01)
USPC ..... 219/222; 34/96; 392/385

(58) Field of Classification Search
None
See application file for complete search history.

(56) References Cited

U.S. PATENT DOCUMENTS

| | | | | |
|---|---|---|---|---|
| 3,797,475 | A * | 3/1974 | Hughes | 126/206 |
| 5,839,204 | A * | 11/1998 | Cinque et al. | 34/97 |
| 6,092,260 | A * | 7/2000 | Kai | 15/320 |
| 6,658,759 | B2 * | 12/2003 | Hu | 34/202 |
| 6,928,235 | B2 * | 8/2005 | Pollack | 392/380 |
| 8,106,279 | B1 * | 1/2012 | Chang | 84/453 |
| 8,137,629 | B2 * | 3/2012 | Faber et al. | 422/120 |
| 8,146,264 | B1 * | 4/2012 | Stefano et al. | 34/96 |
| 2002/0006275 | A1 * | 1/2002 | Pollack | 392/380 |

FOREIGN PATENT DOCUMENTS

| | | | |
|---|---|---|---|
| JP | 04-250108 | A | 9/1992 |
| JP | 2005-087445 | A | 4/2005 |
| JP | 2005-334130 | A | 12/2005 |

* cited by examiner

*Primary Examiner* — Joseph M Pelham
(74) *Attorney, Agent, or Firm* — Seed IP Law Group PLLC

(57) ABSTRACT

Device (1) for drying hair, comprising a hand-held unit (2) which is adapted to emit or discharge a flow of air to be directed onto the hair, characterized in that the hand-held unit (2) has a power source (18) which is arranged in a path (13) of the air flow to be emitted or discharged from the unit (2). In this way, heat or thermal energy that is generated in the power source (18) can be recovered or retrieved and transferred directly to the air flow in the device (1) so as to collect or scavenge waste heat from the power source.

15 Claims, 1 Drawing Sheet

3,4,5
3,4,5

HAIRDRYER APPLIANCE

TECHNICAL FIELD

The present invention relates to a device adapted to emit or discharge a flow of air, e.g. for drying hair, and more particularly to a hairdryer appliance which is adapted to emit or discharge a flow of air to be directed onto hair to be dried.

The hairdryer device of the present invention may be embodied as a hand-held unit suitable for use in the home or domestic environment, as well as in the professional environment, such as in hair dressing salons, and it will be convenient to hereinafter describe the invention in this exemplary context. It will be appreciated, however, that the invention is not necessarily limited to hand-held hairdryer devices, but may also be applicable to larger units mounted on supporting stand arrangements.

BACKGROUND OF THE INVENTION

In both the professional hair-dressing environment and the domestic environment, the use of cordless appliances having their own built-in power supply has become increasingly popular in the past several years. One reason for this is the significantly greater freedom and flexibility for the user of the appliance when movement of the appliance is not limited in space by a physical connection to an external power source, e.g. by a cable connection. The absence of a physical connection to an external power source provides much greater convenience for the user, who is able to move with the appliance in an uninhibited fashion (e.g. around a salon, or around a bathroom) without the need to put the appliance down or to unplug the appliance and plug it in at another location.

The present invention is directed to providing an improved hair-drying appliance, and in particular to an improved hairdryer device having its own power supply.

SUMMARY OF THE INVENTION

According to one broad aspect, the present invention provides a device for drying hair, comprising a unit adapted to provide a flow of air to be directed onto the hair. The unit includes a power source and means for recovering heat from the power source for use in the device. The heat recovery means may be embodied as a forced convection heat-transfer means, with the power source arranged in a path of the air-flow to be emitted or discharged from the unit for collecting or scavenging waste heat from the power source. Preferably, the unit is a hand-held unit.

According to another aspect, the present invention provides a device for drying hair, comprising a unit adapted to emit or discharge a flow of air to be directed onto the hair, wherein the unit has a power source which is arranged in a path of the air-flow that is to be emitted or discharged from the unit, whereby heat energy generated in the power source is transferable to the air-flow.

In a preferred form of the invention, the device has more than one path for the flow of air through the unit, and the power source is arranged in at least one of said air-flow paths through the unit. In this way, heat or thermal energy which is generated in the power source can be transferred directly to the air-flow through the unit. The power source is thereby cooled by the air-flow and the energy level, and thus the temperature, of the air-flow is increased.

In a preferred form of the invention, the device includes fan means for generating the flow of air and the power source is desirably adapted to drive the fan means. In this connection, the device will typically include a motor, such as an electric motor, for driving a fan to generate a forced air-flow through the unit and the power source may be adapted to drive the electric motor. The device will typically also include dedicated heating means for heating the flow of air, with the power source desirably adapted to drive the heating means. Preferably, the power source is arranged in the air-flow path such that it is thermally isolated from the heating means to ensure a maximal temperature differential between the power source and the forced air-flow, thereby to maximise the heat recovery effect (and, thus, also the effective cooling of the power source). In this regard, the power source may be shielded from the heating means by providing a physical and/or thermal barrier between the power source and the heating means, and/or it may be separated or spaced from the heating means e.g. by arranging the power source in the air-flow upstream of the heating means.

In a preferred form of the invention, the power source itself at least partially defines the path of air flow through the unit. That is, the power source preferably comprises at least one surface arranged in a path of the air flow. Thus, the at least one surface of the power source may serve to guide or direct the flow of air through the unit. The at least one surface is typically a surface of an outer wall encasing the power source. In other words, the power source may be an enclosed or encased component such that an outer wall thereof presents the at least one surface for heat transfer to the air-flow through the unit and/or at least partially directs or guides that air-flow.

In a preferred form of the invention, the at least one surface of the power source is configured to enhance heat transfer from the power source to an adjacent air flow through the unit. In this regard, the at least one surface of the power source may comprise a surface profile or surface elements, such as ribs or fins, for enhancing heat transfer from the power source to the adjacent air flow.

In a preferred form of the invention, the power source comprises a power cell or a plurality of power cells. Preferably, for example, the power source comprises one or more electric power cells. Each of the one or more power cells is preferably configured as a battery or voltaic cell, with nickel-cadmium (NiCd), nickel metal hydride (NiMH) and lithium-ion (Li-ion) cells being particularly preferred. It will be appreciated, however, that the power source in the device or appliance of the invention may comprise any of a variety of energy storages. For example, one or more fuel cells (e.g. hydrogen fuel cell) may also be contemplated as the power source in the device of the present invention.

In a particularly preferred form of the invention, the power source comprises a plurality of power cells which are arranged in the path of the air flow through the unit for enhancing heat transfer to the air flow. For example, the individual power cells may be arranged to define air-flow paths there-between.

In a preferred form of the invention, the unit comprises a housing which at least partially defines the path of the air-flow through the unit, and the power source is arranged within the housing. For example, the housing may comprise a channel which extends to an outlet opening, with the flow of air being adapted to be emitted or discharged from the unit though the outlet opening. The power source is therefore preferably arranged at least partially in the channel.

The power source is typically adapted to drive or to power the device of the invention at least partially, and preferably completely. For example, as noted above, the device of the invention may include fan means for generating the flow of air and the power source is desirably adapted to drive the fan means. In this connection, the device will typically include a motor (e.g. an electric motor) for driving a rotary fan to generate a forced air-flow through the unit and the power source may be adapted to drive the electric motor. Also, the device will typically include an independent or dedicated heating means with one or more heating element for heating the flow of air, and the power source is desirably adapted to drive the heating means. That is, the device will typically include at least one heating element (e.g. an electric resistance element) for transferring heat to the air-flow through the unit in the known or conventional manner, and the power source is adapted to drive or to power or activate the said at least one heating element.

In one particular embodiment, the power source in the device or appliance of the invention comprises one or more (e.g. hydrogen) fuel cell that generates the current necessary to drive the motor and/or heating elements. Fuel cells typically have an efficiency in the range of about 40% to 50%. That is, about 40% to 50% of the total energy is transformed into electrical energy, with the remaining energy converted to heat. With the present invention, therefore, that heat energy is able to be recovered and used by the appliance, rather than it simply being lost or dissipated. In other words, in a hairdryer of the invention, the heat generated in the power source is recovered by the air-flow in a forced convection cooling of the power-source as the air travels past in thermal contact with the power source. As an example, therefore, a hair-dryer having an output of 1000 W could be realised using a fuel cell having an electrical output of only 500 W. That is, based on a 50% efficiency, approx. 500 W of energy would be dissipated in the fuel cell as heat which could then be recovered and used by the hairdryer of the invention.

In a preferred form of the invention, the power source of the device is removable and/or replaceable. In this way, if the power source—e.g. one or more power cell—becomes depleted or exhausted, it may be removed and replaced with a new power cell. Further, the power source is preferably renewable or replenishable. Thus, if the energy that was stored in the power source—e.g. one or more power cell—becomes depleted or exhausted, the power source can be renewed or replenished so that the energy therein is substantially restored. In this case, it may not be necessary to remove and/or replace a depleted or exhausted power cell with a new power cell. Rather, the energy of the existing power cell may simply be renewed or replenished. Where, for example, the power source comprises one or more electric power cell in the form of a battery or voltaic cell, the power cell(s) may be rechargeable. Thus, the electrical potential of the power cell (s) can be replenished or recharged in a manner as is known in the art. For example, the hair-dryer device may simply be connected to a recharging station. The recharging station may comprise a stand or mount, upon which the device can be temporarily placed to recharge the depleted power cell. Alternatively, the device may be connected to an external power supply—e.g. to a standard "mains" or household electricity supply—to effect recharging of the internal or built-in power source. In this regard, the device of the invention is also preferably adapted for operation via a standard cable connection to a standard "mains" or household electricity supply.

According to another aspect, the present invention provides an appliance comprising a built-in power source and heat recovery means for recovering heat from the power source for use in the appliance. The heat recovery means is desirably embodied as a forced convection heat-transfer means. Thus, the power source may be arranged to be subjected to a moving fluid mass (e.g. air) for collecting or scavenging waste heat from the power source for use in the appliance. For example, the power source may be arranged in a path of air flow through and/or from the appliance. The appliance of the invention is preferably a hand-held appliance and is typically adapted to emit or discharge a flow of air, e.g. for drying hair. The appliance is preferably a household appliance for domestic use.

According to a further aspect, the invention provides an appliance for drying hair, comprising a unit adapted to emit or discharge a flow of air to be directed onto the hair, wherein the unit has a power source which is arranged to transmit heat to the air emitted or discharged from the unit by direct contact with that air.

Thus, the present invention provides an improved hair-dryer appliance configured as a hand-held unit having an internal or built-in power source. During operation of the power source (e.g. power cell) to provide energy to drive the hair-dryer appliance, heat is generated within the power cell. By arranging the power cell in the path of the air-flow through the hair-dryer appliance, more of the total energy output within the power cell can be transferred to and effectively used by or in the appliance. This provides more energy-efficient use of the power cell and, as a result, a longer operating time of the power cell before recharge or replacement becomes necessary. A further advantage of this solution is that, because the power source (e.g. power cell) is cooled by the air-flow during discharge, the service-life of the power source can be increased due to the lower operating temperature.

BRIEF DESCRIPTION OF THE DRAWINGS

The above and further features and advantages of the invention will become more readily apparent from the following detailed description of preferred embodiments of the invention with reference to the accompanying drawings, in which like reference characters identify like features, and in which.

DETAILED DESCRIPTION OF THE PREFERRED EMBODIMENTS

Figures 1, 2, 3, 4, 5:
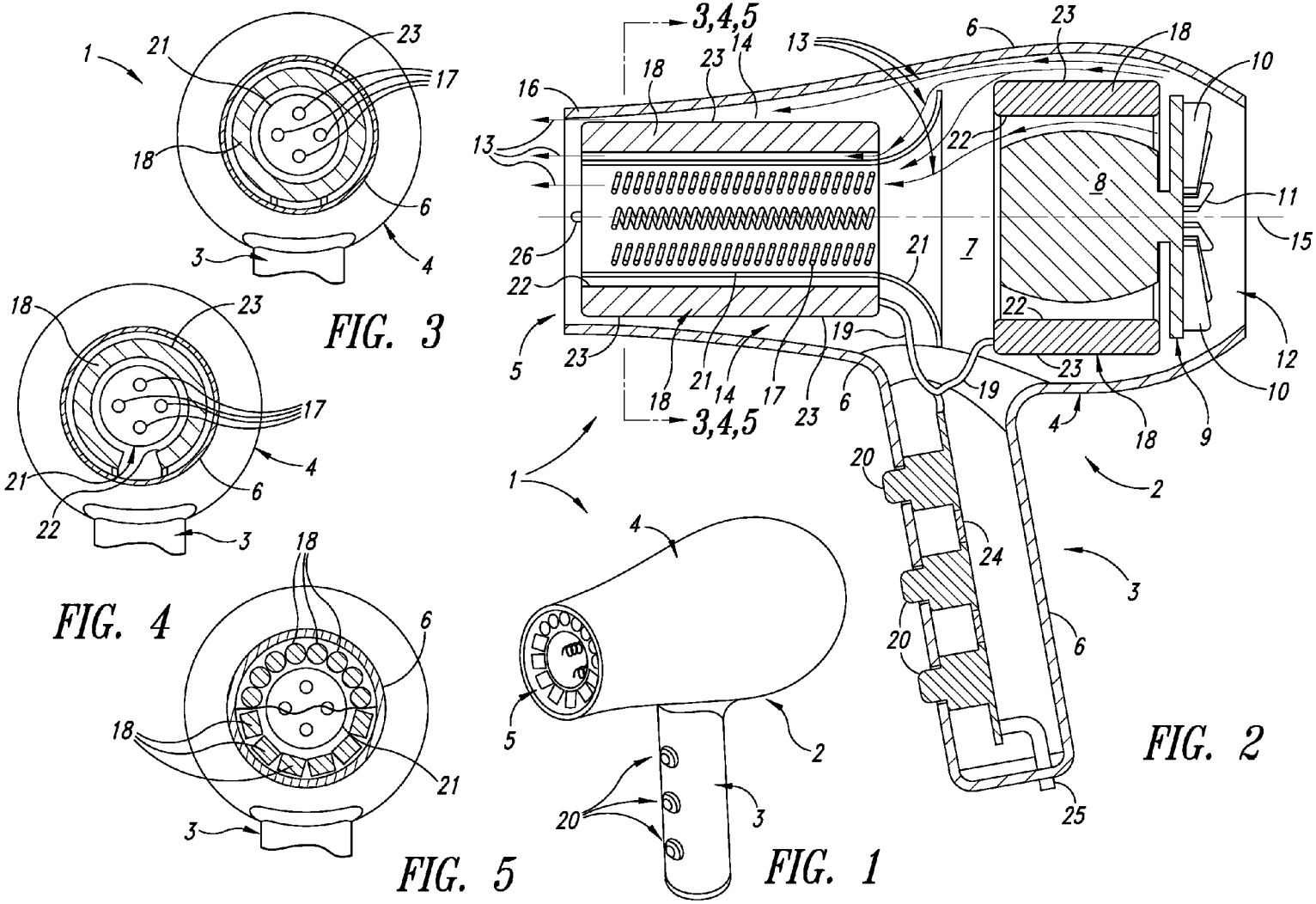
FIG. 1 is a schematic perspective view of a hand-held hair-dryer appliance according to a preferred embodiment of the invention.
FIG. 2 is a schematic sectional view of a hand-held hair-dryer appliance according to a preferred embodiment of the invention.
FIG. 3 is a schematic sectional view in the direction of the arrows B-B in FIG. 2.
FIG. 4 is an alternative sectional view in the direction of the arrows B-B in FIG. 2, representing an alternative embodiment of the invention.
FIG. 5 is a further alternative sectional view in the direction of arrows B-B in FIG. 2, representing a further alternative embodiment of the invention.

With reference to FIG. 1 of the drawings, a hairdryer device 1, also referred to herein as a hairdryer appliance, according to an embodiment of the invention is illustrated. The hairdryer device 1 consists of a hand-held unit 2 comprising a handle part 3 to be gripped and held in the hand of the user, and a body part 4 which is designed to emit or discharge a flow of heated air from the unit 2 through an outlet opening 5. This flow of heated air is to be directed onto the hair to be dried, as is known in the field of hairdryer appliances.

With reference now to FIG. 2 of the drawings, a schematic cross-sectional view of a hand-held hairdryer appliance 1 according to an embodiment of the invention is shown. In particular, the various internal components of the hairdryer appliance 1 are illustrated schematically. The appliance 1 comprises a casing or housing 6 which is formed as a shell and is typically moulded from a polymer plastics material. In this embodiment, the casing or housing 6 forms both the handle part 3 and also encloses or encases the body part 4 of the device 1.

The housing 6 defines a cavity 7 within which the main operational components of the appliance 1 are mounted. For example, the hairdryer device includes an electric motor 8 which is adapted to drive a rotary fan 9 having a plurality of radially extending fan vanes 10 mounted at an end of a rotor component or shaft 11 of the motor 8. Thus, upon activation of the electric motor 8, the fan impeller 9 is rotated and the rotating vanes 10 act to draw air into the housing 6 via an inlet opening 12 adjacent the fan 9 and to drive the air along a plurality of air flow paths 13 through the cavity 7 of the housing 6 towards the outlet opening 5.

The cavity 7 in the housing 6 of the hairdryer appliance 1 includes a channel 14 which extends more or less symmetrical around a rotational axis 15 of the motor 8 towards the outlet opening 5. This channel 14 converges somewhat towards the outlet opening 5 to form a discharge nozzle 16 for the air-flow emitted or discharged from the unit 2. Arranged along the length of the channel are a plurality of electric heating elements 17, which are configured and arranged to transfer heat energy to the air driven through the cavity 7 by the operation of the fan 9. In this way, the air discharged by the hair-dryer appliance 1 can be heated to a desired temperature, i.e. optionally selected by the user, to dry the hair of the person concerned effectively.

A particular characteristic of the hairdryer appliance 1 resides in the provision of an internal or built-in power source arranged in the hand-held unit 2 in one or more of the paths 13 of the air flow through the unit 2 that is to be emitted or discharged from the outlet opening 5. In this particular example, the power source is provided in the form of two electric power cells 18 having a substantially cylindrical shape. A first one of the electric power cells 18 is arranged substantially surrounding the electric motor 8 adjacent the fan 9 and a second one of the electric power cells 18 is arranged in the channel 14 of the housing 6. The second power cell 18 extends around and/or substantially surrounds the heating elements 17, but is spaced radially outwardly from those heating elements 17 and is separated from them by a heat shield, which is discussed in more detail below.

Each of the power cells 18 is typically formed as a battery, such as a nickel-cadmium (NiCd), nickel metal hydride (NiMH) or lithium-ion (Li-ion) battery. The power cells 18 are electrically connected by wiring 19 to a number of switch actuators 20 (here push-button-type switches) arranged in the handle part 3 and to the electric motor 8. Electronic circuitry for controlling the operation of the hair-dryer appliance 1 may be incorporated (e.g. on a circuit board 24) within the handle part 3 of the device. The switches 20 may, for example, be mounted on or connected to a control board. The power cells 18 are typically also connected to the heating elements 17 by a further wiring connection (not shown).

With reference to FIG. 2 and FIG. 3 of the drawings, the hair-dryer appliance 1 in this embodiment of the invention further comprises a heat shield 21 which is adapted to form a thermally insulating barrier between the heating elements 17 and the second power cell 18. In this way, the second power cell 18 is shielded from, and thus not negatively influenced by, the heat generated by the heating elements 17. The heat shield 21 may have an at least partially cylindrical shape which extends between the heating elements 17 and the second power cell 18. As can be seen from FIG. 2 of the drawings, the inner end of the heat shield 21 diverges outwardly in a flared, curved fashion. Thus, the heat shield 21 may also form a guide surface for guiding or directing the air flow generated by the fan through the channel 14 to the outlet opening 5. That is, the heat shield 21 may at least partially define the paths 13 of the air flow through and/or from the hand-held unit 2 of the hair-dryer device 1.

During operation of the hair-dryer appliance 1, the power cells 18 may discharge their entire power capacity within a period of several minutes. During the discharge of the power cells 18, a certain amount of the energy released by the power cells is released as heat. As such, the power cells 18 may themselves become quite warm during operation. According to the invention, the heat generated in each of the power cells 18 during discharge of their power capacity is able to be recovered, retrieved or scavenged by the air flowing adjacent the power cells. In this regard, the radially inwardly facing outer surface 22 and the radially outwardly facing outer surface 23 of each of the power cells 18 at least partially define the flow paths 13 for the forced air-flow generated by the fan 9. Thus, the air flows generated by the fan are directed adjacent and along these surfaces 22, 23. These surfaces 22, 23, which are at least partially thermally insulated by the heat shield 21 from any direct influence of the heating elements 17, are thereby adapted to transfer heat energy from the power cells 18 to the air flowing through the cavity 7 of the appliance housing 6. In other words, the heat generated within the power cells 18 is transferred to the air flow to thereby increase the heating effect with no additional power consumption. This enables the heating elements 17 to operate with a lower power consumption for an equivalent overall heating effect.

With regard to the operation of the device, the control switches 20 provided in the handle part 3 of the appliance 1 may include a power on/off switch for activating or deactivating the appliance and may also include one or more switches with which a user may select a particular temperature setting for the air-flow. When operated at a low temperature setting, for example, the heating elements 17 may not be activated at all, or only at low level, so that heating of the air-flow through the device 1 occurs primarily due to heat transfer from the power cells 18. At a higher temperature setting, the heating elements 17 may impart a substantial amount of heat energy to the air-flow, which is then supplemented by heat transfer from the power cells 18. In this connection, for a maximum temperature gradient between the power cells 18 and the forced air-flow (i.e. for maximum heat transfer) it is desirable to isolate the power cells 18 from the heating elements 17 by providing a physical barrier such as the heat shield 21 and/or by arranging the power cells 18 spaced upstream of the heating elements 17 in the air-flow.

It will be understood that the provision of just one of the power cells 18 (instead of both) in the hair-dryer appliance 1 would still embody the concept of the present invention. But by including two or more power cells 18 as shown in the drawings, it may thus be possible to increase the total energy storage in the device and also to provide a more even weight distribution for more comfortable handling by the user. Preferably, therefore, the power cells are arranged for an even weight distribution.

The power cells 18 are desirably embodied as rechargeable cells and, ordinarily, the hair-dryer appliance 1 may be operated as a cordless device. Connectors 25, 26 are provided for connecting the power cells 18 to an external power source, such as to a "mains" or household electricity supply or to a recharging station. One of these connectors 25 is provided in the base of the handle 3 and is preferably adapted for the connection of a cable (not shown) to operate the appliance from the external power supply in a conventional manner and/or for recharging the power cells 18. The other connector 26 is provided at the discharge outlet 5 of the nozzle 16 and is designed for contact with an external power source when the appliance is mounted on a recharging station. In particular, the hair-dryer appliance 1 is designed to be inserted or mounted via the nozzle 16 on the recharging station when not in use. The nozzle 16 may include registration means (not shown) for ensuring the correct orientation and/or correct placement of the appliance on the recharging station.

FIGS. 4 and 5 of the drawings illustrate alternative configurations for the power source 18 in alternative embodiments of the invention. In FIG. 4, for example, the power source 18 again includes a power cell arranged to extend around the heating elements 17 radially outwardly of the heat shield 21, but this time this power cell 18 has only a partially cylindrical form. In particular, a portion of the cylindrical form is absent so that the power cell 18 does not completely surround or encompass the centrally arranged heating elements 17.

In FIG. 5, the power source 18 comprises a plurality of elongate power cells preferably arranged substantially circularly around the heating elements 17 radially outwardly of the heat shield 21 and extending longitudinally of the channel 14 through the housing 6. The individual power cells 18 can be seen to have circular and rectangular cross-sections. As can be seen by a comparison, the embodiment in FIG. 5 corresponds to the embodiment illustrated in FIG. 1 of the drawings. The spacing between each of the circularly arranged elongate power cells which extend towards the outlet nozzle 5 facilitates the flow of air there-between. This increases the surface area in contact with the air-flow and thereby enhances the heat transfer from the individual power cells 18.

It will be appreciated that the above description of the preferred embodiments of the invention with reference to the drawings has been made by way of example only. Accordingly, a person skilled in the art will appreciate that various alterations and/or additions may be made to the parts particularly described and illustrated without departing from the scope of the invention as defined in the appended claims. In this connection, it will be appreciated that the concept of the present invention may also be applicable to appliances other than hair-dryers, which are adapted to discharge or to emit a flow of air.

The invention claimed is:

1. A device for drying hair, comprising a unit adapted to provide a flow of air to be directed onto the hair, characterized in that the unit has a power source which is arranged in a path of the flow of air for transfer of heat or thermal energy generated in the power source to the flow of air, wherein the power source at least partially defines the path of flow of air through the unit, wherein the power source has a channel therethrough that is disposed along a central axis aligned with the path of the flow of air, the channel being defined by one or more inwardly facing surfaces of the power source which extend along the path of the flow of the air to guide or direct the flow of air through the unit.

2. The device of claim 1, wherein the unit has more than one path for air flow through the unit, and wherein the power source is arranged in at least one of said air-flow paths.

3. The device of claim 1, wherein the unit comprises a housing which at least partially defines the path of the air flow through the unit, wherein the power source is arranged within the housing.

4. The device of claim 1, wherein a housing comprises a channel which extends to an outlet opening, though which the flow of air is emitted or discharged from the unit, and wherein the power source is arranged in the channel.

5. The device of claim 1, wherein the power source is adapted to drive the device, at least partially.

6. The device of claim 5, wherein the unit includes fan means for generating the flow of air, and the power source is adapted to drive the fan means.

7. The device of claim 5, wherein the unit includes one or more heating elements for heating the flow of air, and the power source is adapted to drive the heating means.

8. The device of claim 1, wherein the unit is a hand-held unit.

9. The device of claim 1, wherein the power source comprises one or more electric power cells, preferably in the form of a battery.

10. The device of claim 1, wherein the power source is replaceable and/or rechargeable.

11. The device of claim 1, wherein at least one of the one or more inwardly facing surfaces of the power source includes a surface profile or surface elements for enhancing heat transfer from the power source to the flow of air.

12. A hairdryer appliance having a built-in power source, characterized in that the power source is arranged in a path of air flow through and/or from the appliance, such that heat energy generated in the power source is transferred to the airflow, wherein the power source at least partially defines the path of air flow through and/or from the appliance, wherein the power source has a channel therethrough that is disposed along a central axis aligned with the path of air flow, the channel being defined by one or more inwardly facing surfaces of the power source which extend along the path of air flow to guide or direct the air flow through the appliance.

13. A device for drying hair, comprising a unit adapted to emit or discharge a flow of air to be directed onto the hair and a power source for driving the device which is adapted to heat the air to be emitted or discharged from the unit by direct contact with the flow of air, wherein the power source at least partially defines a path of the flow of air through the unit, wherein the power source has a channel therethrough that is disposed along a central axis aligned with the path of the flow of air, the channel being defined by one or more inwardly facing surfaces of the power source which extend along the path of the flow of air to guide or direct the flow of air through the unit.

14. A hairdryer appliance comprising an electrical power source and heat recovery means for recovering heat from the power source for use by the appliance, the heat recovery means comprising a forced convection heat-transfer means, with the power source being arranged in a path of a flow of air through the appliance for transfer of heat or thermal energy generated in the power source to the flow of air to collect or scavenge waste heat from the power source, wherein the power source at least partially defines the path of the flow of air through the appliance, wherein the power source has a channel therethrough that is disclosed along a central axis aligned with the path of the flow of air, the channel being defined by one or more inwardly facing surfaces of the power source which extend along the path of the flow of air to guide or direct the flow of air through the appliance.

15. An appliance comprising a built-in power source and heat recovery means for recovering heat from the power source, the heat recovery means comprising a forced convection heat-transfer means, whereby the power source is arranged to be subjected to a moving fluid mass for collecting or scavenging waste heat from the power source for use in the appliance, wherein the power source at least partially defines path of the moving fluid mass through the appliance, wherein the power source has a channel therethrough that is disposed along a central axis aligned with the path of the moving fluid mass, the channel being defined by one or more inwardly facing surfaces of the power source which extend along the path of the moving fluid mass to guide or direct the flow of the moving fluid mass through the appliance.

* * * * *